US007644453B2

(12) United States Patent
Dyckow

(10) Patent No.: US 7,644,453 B2
(45) Date of Patent: Jan. 12, 2010

(54) SHOWER CURTAIN FASTENING SYSTEM

(76) Inventor: Dean W. Dyckow, 7655 Malo, Brossard, Québec (CA) J4Y-1C8

( * ) Notice: Subject to any disclaimer, the term of this patent is extended or adjusted under 35 U.S.C. 154(b) by 176 days.

(21) Appl. No.: 11/062,545

(22) Filed: Feb. 23, 2005

(65) Prior Publication Data

US 2006/0185072 A1 Aug. 24, 2006

(51) Int. Cl.
*A47K 3/022* (2006.01)

(52) U.S. Cl. ..... 4/609

(58) Field of Classification Search ..... 4/558, 4/608, 609

See application file for complete search history.

(56) References Cited

U.S. PATENT DOCUMENTS

| | | | | |
|---|---|---|---|---|
| 2,049,061 | A | 7/1936 | Hoegger | 4/609 X |
| 2,303,502 | A | 12/1942 | Rous | 4/608 X |
| 2,319,292 | A | 5/1943 | Boggs | 24/303 X |
| 2,554,106 | A | 5/1951 | Heubeck | 4/610 X |
| 2,608,250 | A | 8/1952 | Meyer | 4/608 X |
| 2,771,945 | A | 11/1956 | Wittrup | 4/608 X |
| 3,102,314 | A | 9/1963 | Alderfer | 24/303 |
| 3,205,547 | A | 9/1965 | Riekse | 4/558 X |
| 3,282,328 | A | 11/1966 | Mushro | 4/608 X |
| 3,386,106 | A | 6/1968 | Clemens | 4/608 |
| 3,639,919 | A | 2/1972 | White | 4/558 |
| 3,808,610 | A | 5/1974 | Mortensen | 4/558 |
| 3,855,642 | A | 12/1974 | Blitch | 4/609 |
| 3,879,806 | A | 4/1975 | Armstrong | 4/610 |
| 3,895,399 | A | 7/1975 | Giarrante | 4/558 |
| 3,934,636 | A | 1/1976 | Simmons | 4/608 X |
| 4,070,735 | A | 1/1978 | Canaday | 4/558 X |
| 4,077,072 | A | 3/1978 | Dezura | 4/558 |
| 4,088,174 | A | 5/1978 | Edwards | 4/608 X |
| 4,197,616 | A | 4/1980 | Panuski | 4/609 X |
| 4,333,187 | A | 6/1982 | Schuler | 4/608 |

(Continued)

FOREIGN PATENT DOCUMENTS

| | | |
|---|---|---|
| CA | 960956 | 1/1975 |

(Continued)

*Primary Examiner*—Robert M Fetsuga
(74) *Attorney, Agent, or Firm*—Goudreau Gage Dubuc; Gonzalo Lavin

(57) ABSTRACT

The present invention relates to a kit for use in a shower enclosure with a shower curtain. The kit contains a wall component, a connecting component and a retaining component. The wall component has a back wall and at least one front wall, and is removably attachable to a wall surface of the shower enclosure. The connecting component has both a front portion and back portion. The back portion is detachably connectable to one of said at least one front wall of the wall component by means of magnets attached thereto. Once the wall component and connecting component are connected together, they form a watertight barrier. The front portion of the connecting component contains a protrusion in the form of two spaced apart, elongated arms that are each provided with an abutting edge against which part of the shower curtain may be positioned. The retaining component is detachably connectable to the protrusion of the connecting component with the part of the shower curtain snapped in between. The retaining component has a pair of arms with end edges that face toward each other and are sized to snap onto the abutting edges of the elongated arms of the protrusion of the connecting component with the part of the shower curtain pinched in between.

7 Claims, 5 Drawing Sheets

U.S. PATENT DOCUMENTS

| | | | | | |
|---|---|---|---|---|---|
| 4,361,915 | A | | 12/1982 | Siewert | 4/608 |
| 4,594,741 | A | | 6/1986 | Payne | 4/558 |
| 4,759,087 | A | | 7/1988 | Zeilinger | 4/608 X |
| 4,771,517 | A | * | 9/1988 | Bonanno | 4/609 X |
| 4,887,324 | A | | 12/1989 | Cairns | 4/609 |
| 4,944,050 | A | | 7/1990 | Shames et al. | 4/609 |
| 5,083,330 | A | * | 1/1992 | Dusar | 4/608 |
| 5,148,580 | A | | 9/1992 | Dyckow | 4/608 X |
| 5,228,149 | A | | 7/1993 | Phinn, Jr. | 4/558 |
| 6,067,672 | A | | 5/2000 | Klotz | 4/609 |
| 6,094,755 | A | | 8/2000 | Matta | 4/558 |
| 6,148,452 | A | * | 11/2000 | Kirsopp | 4/609 |
| 6,199,225 | B1 | | 3/2001 | Colvin | 4/558 |
| 6,510,566 | B2 | | 1/2003 | Bryce | 4/609 |
| 6,789,279 | B2 | | 9/2004 | Yarid | 56/10.2 E |

FOREIGN PATENT DOCUMENTS

| | | |
|---|---|---|
| CA | 997670 | 9/1976 |
| CA | 2198154 | 8/1998 |

* cited by examiner

SHOWER CURTAIN FASTENING SYSTEM

FIELD OF THE INVENTION

The present invention relates to a kit for use in a shower enclosure with a shower curtain. More specifically, the present invention relates to kit wherein part of the shower curtain snapped thereon, and is capable of forming a water-tight barrier, thus preventing any splashing water from leaving the shower enclosure.

BACKGROUND OF THE INVENTION

Shower enclosures typically comprise a back wall and two opposing side walls. One side of the walls typically includes a shower fixture having a water spraying shower head, while a shower curtain or shower door is used to close off the front of the shower enclosure and is typically positioned between the two opposing side walls.

Shower curtains are often preferable to the more permanent shower door constructions. Shower curtains are usually manufactured from flexible water proof plastic sheet materials and other fabrics, which are less expensive than door assemblies made of expensive rigid plastic or glass. Additionally, shower curtains require only a simple support rod for the curtain to be hung in place between the opposing side walls of the enclosure.

A disadvantage associated with free falling shower curtains, when used in specially designed shower enclosures, is the fact that water spray from the shower head has a tendency to escape through a gap which separates the side edges of the shower curtain from the side walls of the shower enclosure. The so escaped water usually winds up on the exterior wall and floor surfaces, thus making them slippery and dangerous, as well as possibly causing serious damage to aforementioned surfaces. In using shower curtains in humid and wet environments, another major disadvantage is that soap scum and mildew will easily build-up. Such build-up may be hazardous to ones health and is most definitely unaesthetic in a bathroom.

Numerous attempts have been made at retaining the edges of shower curtains at the side walls of the shower enclosure to effectively seal the shower enclosure from escaping water spray. These attempts typically use a shower curtain closure assembly which is attached to the side wall.

Previous shower curtain closures of this type are known to the Applicant, and are illustrated in, for example, U.S. Pat. No. 2,049,061 (Hoegger); U.S. Pat. No. 3,205,547 (Riekse); U.S. Pat. No. 3,808,610 (Mortensen); U.S. Pat. No. 3,879,806 (Armstrong); U.S. Pat. No. 4,077,072 (Dezura); U.S. Pat. No. 4,594,741 (Payne); U.S. Pat. No. 4,759,087 (Zeilinger); U.S. Pat. No. 4,887,324 (Cairns); U.S. Pat. No. 5,148,580 (Dyckow); U.S. Pat. No. 5,228,149 (Phinn, Jr.); U.S. Pat. No. 6,067,672 (Klotz); U.S. Pat. No. 6,094,755 (Matta); U.S. Pat. No. 6,199,225 B1 (Colvin); U.S. Pat. No. 6,510,566 B2 (Bryce) and U.S. Pat. No. 6,789,279 B2 (Yarid) as well as Canadian patent no. 2,020,320 (Dyckow) and Canadian patent application no. 2,198,154 (Dyckow).

Briefly, U.S. Pat. No. 2,049,061 discloses a system in which an edge of a shower curtain, fitted with beads, is snapped into a corresponding rectangular elongated channel member, which has been previously installed along a wall of the shower bath alcove.

U.S. Pat. Nos. 3,205,547 and 4,759,087 disclose the use of rubberized mating arrangements for sealingly joining the edges of the curtains to the walls of the shower enclosure. A problem associated with using such arrangements is that the rubber material tends to loosen in the hot, wet and humid environment of the shower. This problem is serious in that the lifecycle of the arrangement in the '547 patent is significantly reduced. In addition, the arrangements described hereinabove are difficult to operate because of the need to manipulate the insertion piece to seal and unseal the edge.

U.S. Pat. No. 3,808,610 uses Velcro™ strips for joining the curtain edge to the wall. Additionally, it requires a rail-type arrangement to be mounted on each wall which is difficult to use.

U.S. Pat. No. 4,077,072 also uses Velcro™ strips along the walls and Velcro dots for matingly joining with the Velcro strips. Because the Velcro strips and dots are not continuous, water can seep through between the edges of the curtains and the walls. Thus, this arrangement does not provide a seal.

Relatively based on the same principle disclosed in the U.S. '072 patent, U.S. Pat. No. 5,228,149 uses curtain mounted pads which are matedly joined to a series of wall mounted pads. The pads are positioned in such a way so as to produce a shower curtain tensioning effect. Nevertheless, water still manages to seep out of the shower enclosure, as a space exists between the shower wall and top of mounted pads.

As can be seen in FIG. 1, entitled "PRIOR ART", of the present application, U.S. Pat. No. 4,594,741 discloses an elongated strip magnet assembly mounted on each side of a shower curtain to secure in a closed position the shower curtain across the access opening of a bathing enclosure. Such is done by make use of a series of rigid strips in which a shower curtain is placed thereon. One of the disadvantages associated with this particular assembly is that the deflectable clip does not properly mount over the deflectable strip and such especially when the shower curtain is of variable thicknesses. In fact, the deflectable clip can too easily be removed from the solid strip as its protruding portions (closely positioned to the recesses) are too rounded. Additionally, the proturbence of this assembly would also be more likely to facilitate the disengagement of the curtain from the strip, and such when portions of exceeding shower curtain of different widths and/or thicknesses are present.

U.S. Pat. No. 4,887,324 discloses a one-piece molding that grips a curtain by locking a small portion of the curtain between a rib on one arm and a groove on a second arm. The arms of this molding are swingable about a third arm through living hinges, and the first arm is adapted to be affixed against a wall of a shower enclosure. The shower curtain is pressed against the wall by one of the arms. A drawback associated with this type of system is that due to its construction, the living hinges can easily snap off. Moreover, it is difficult to install this type of molding as only a small portion of the curtain is to be inserted in the device.

U.S. Pat. No. 5,148,580, in the name of the Applicant, discloses a kit for use to fasten the outer surface of a shower curtain to an adjacent wall in the shower closure. A sealing protrusion extends from the wall adjacent the fasteners so that, when the outer surface of the curtain is fastened to the wall, the edge of the curtain abuts the protrusion. This U.S. patent does not suggest or disclose a means of retaining a shower curtain onto a corresponding connecting component as described in the present application.

U.S. Pat. No. 6,067,672 uses a threaded fastener, containing threaded nuts and shafts, to semi-permanently hold in place an adjustable clamp which receives a shower curtain. This system is not only difficult to install, but for a person to use especially when he or she would like to rapidly exit the shower enclosure.

U.S. Pat. No. 6,094,755 discloses a device, comprised of two magnetic strips, that eliminates a space between a wall of a partial enclosure of a shower enclosure and a shower curtain by maintaining an edge of the shower curtain close to the wall. In operation, a user places the shower curtain between the two magnetic strips of the device, and because of their magnetic properties, the second strip superposes itself onto first strip is adhered onto a wall of the shower enclosure. When the curtain is pulled, the strips self-release from one another, thus allowing the user to exit the shower enclosure. The use of this kind of device is clearly contrary the present invention as disclosed herein.

U.S. Pat. No. 6,199,225 B1 discloses a curtain arrangement for attaching a shower curtain to one of the shower enclosure's wall with Velcro™.

U.S. Pat. No. 6,510,566 B2 discloses a shower curtain closure for closing off a vertical side edge of the curtain against a wall of the shower stall containing a length of extruded plastic tubing, a tube support ring for suspending the tube on the curtain rod, and an elongate vertically oriented wall receptacle into which the tube matingly fits. Basically, the tube is passed through a sleeve along the side of the curtain and is suspended from the curtain support rod by a ring connected to the upper end of the tubing and passing over the shower curtain rod. The device disclosed in this U.S. patent is difficult to use, as a user is expected to successfully wrap a portion of a shower curtain around a rod while inserting it simultaneously into a corresponding channel. This system is also contrary to the invention as disclosed in the present application.

U.S. Pat. No. 6,789,279 B2 discloses a long rod that has a hanging hook at one end is attached to the leading vertical edge of the inner shower curtain or shower curtain liner and is hung on a hook located at shower curtain rod height inside the shower or bath/shower enclosure or attached to a wall mounted upper rod clip.

Although similar in construction to the present invention, Canadian patent application no. 2,198,154 makes use of groove and spline system to pinch and hold the shower curtain in place. Upon using the aforementioned design, mildew, bacterial and soap scum buildup became apparent to the naked eye, as these undesired products built-up on the components of the kit. Another drawback associated to this particular system is that the spline frequently pops out of the groove and the shower curtain enclosure kit is therefore rendered ineffective.

Additionally, it is timely to pinch the spline in a continuous manner into the corresponding groove.

Using a similar type of channel type system as described in Canadian patent application no. 2,198,154, for example, a groove and spline type system, is disclosed in U.S. Pat. No. 3,879,806. This U.S. patent proposes to solve the problem of water spraying by engaging the curtain with a loose connecting bar that is placed into and supported by a wall attachment component having the form of a channel. This U.S. patent exhibits the same problems as described in the above Canadian patent application no. 2,198,154.

While the prior art offers proposed solutions for containing water within a shower stall or enclosure, none teach a simple and cost-effective kit that accomplishes the goal of preventing splashing water from leaving the shower enclosure. The manner by which this goal is achieved in the present invention will become more apparent from the following description.

OBJECTS OF THE INVENTION

It is therefore an object of the invention to provide a kit of the type described hereinabove, which overcomes the disadvantages of the prior art, namely preventing the splashing of water from a shower head on a wall above a bathtub to the exterior of the tub.

It is a more specific object of the invention to provide a kit for sealingly and removably joining at least one edge of a shower curtain to a wall of the shower enclosure in such a manner as to fully seal this enclosure even if use is made of hand shower.

SUMMARY OF THE INVENTION

In accordance with the invention, there is provided a kit for use in a shower enclosure with a shower curtain, said kit comprising:

a wall component having a back wall and at least one front wall, the back wall being removably attachable to a wall surface of the shower enclosure;

a connecting component having a front portion and a back portion, said connecting component having its back portion detachably connectable to one of said at least one front wall of the wall component by means of magnets attached thereto, said wall component and said connecting component once connected forming a watertight barrier, the front portion of said connecting component having a protrusion in the form of two spaced apart, elongated arms that are each provided with an abutting edge against which part of the shower curtain may be positioned; and a retaining component detachably connectable to the protrusion of the connecting component with the part of the shower curtain snapped in between, said retaining component comprising a pair of arms with end edges that face toward each other and are sized to snap onto the abutting edges of the elongated arms of the protrusion of the connecting component with the part of the shower curtain pinched in between.

Other objects, features, and advantages of the invention should be apparent from the following description of the preferred embodiment thereof as illustrated in the accompanying drawings.

DETAILED DESCRIPTION OF THE INVENTION

Figure 1:
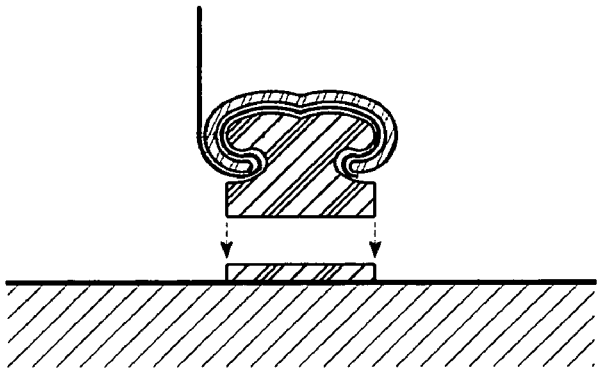
fig.1 PRIOR ART
FIG. 1, entitled "PRIOR ART", is a cross-sectional view of a shower curtain retainer apparatus known to a person skilled in the art.
Figure 2:
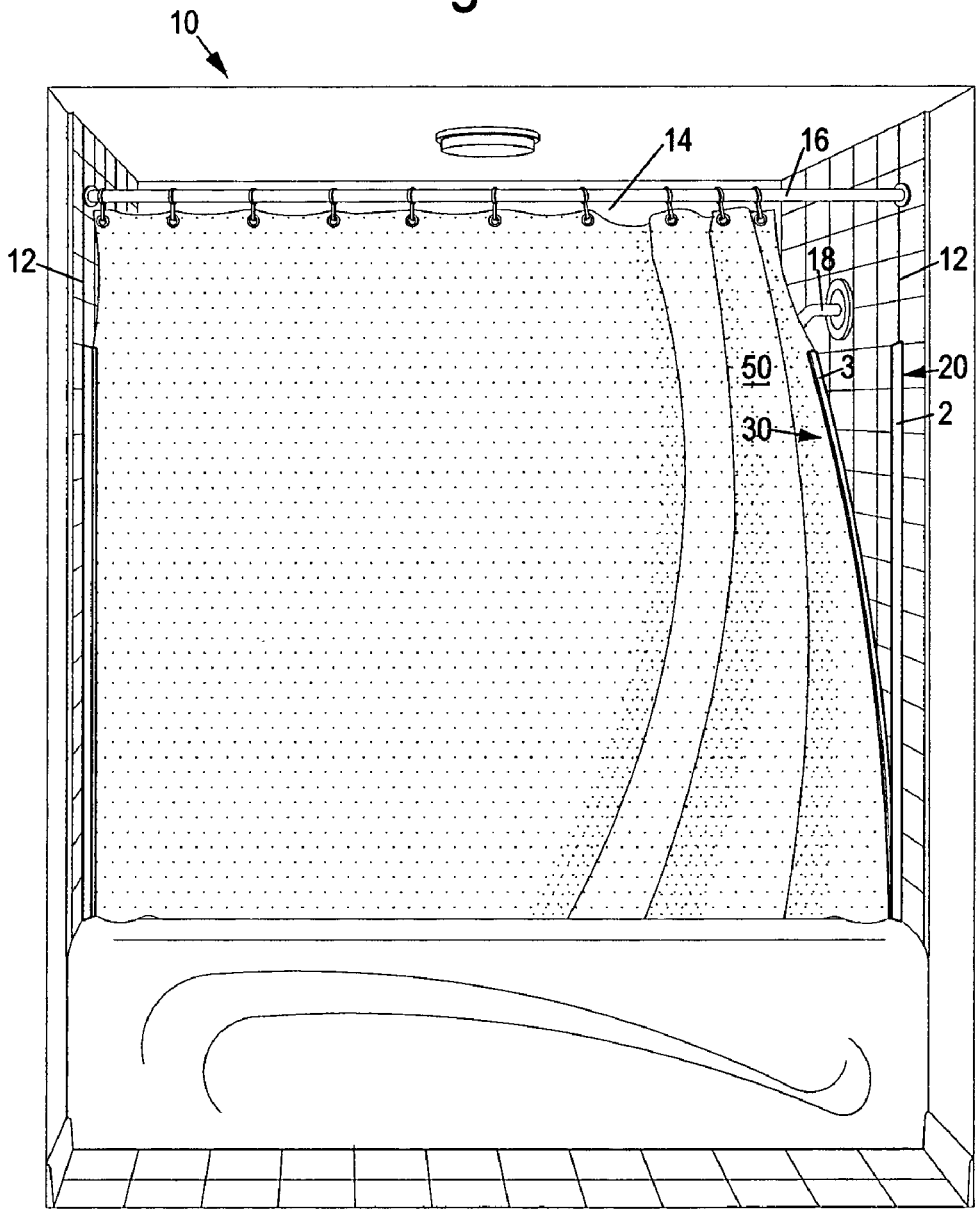
FIG. 2 is a front view of the kit according to a preferred embodiment of the invention.

FIG. 2 generally illustrates a shower enclosure 10 comprising two wall surfaces 12 and a back wall 14. Extended between the wall surfaces 12 is a shower curtain 50, which is mounted onto a shower rod 16. A shower head 18 can also mounted on either one of the wall surfaces 12. Indeed, within the confines of the aforementioned shower enclosure 10 with a shower curtain 50, a person can easily install and use the kit 1 according to the present invention to form a watertight barrier so as to prevent splashing water from leaving the shower enclosure 10.

To illustrate the kit 1 according to the present invention, reference can be made to FIGS. 2 to 5 where it can be noticed that the kit 1 comprises a wall component 20, a connecting component 30 and a retaining component 40. Generally, the wall component 20 contains a back wall 22 and at least one front wall 24. The back wall 22 of the wall component 20 is removably attachable to a wall surface 12 of the shower enclosure 10. Such is achieved by making use of one of several techniques known to a person skilled in the art. Indeed, one such technique of removably attaching the back wall 22 of the wall component 20 to the wall surface 12 of the shower enclosure 10 is by means of an adhesive such as two sided tape, glue and/or other materials containing inherent adhesive properties. Other techniques of affixing the back wall 22 of the wall component 20 to the wall surface 12 include, but are not limited to, the use of screws and/or any other fastening means known to a person skilled in the art.

Figure 4:
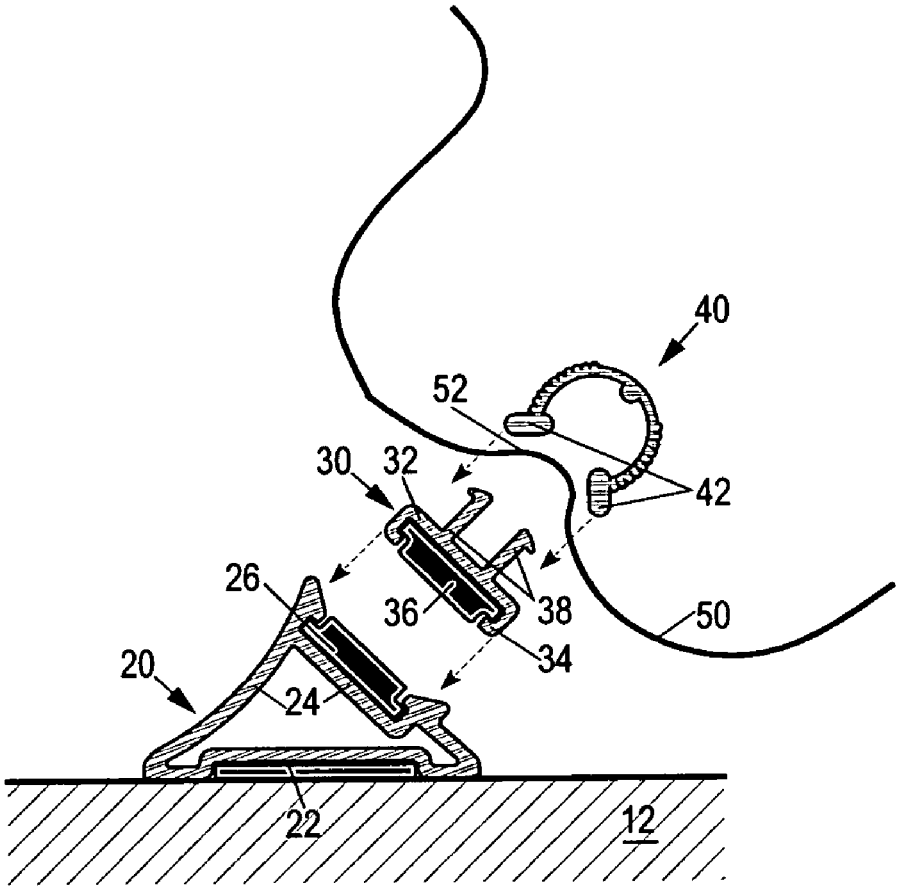
FIG. 4 is a cross-sectional view of the kit according to the present invention in an open position.
Figure 5:
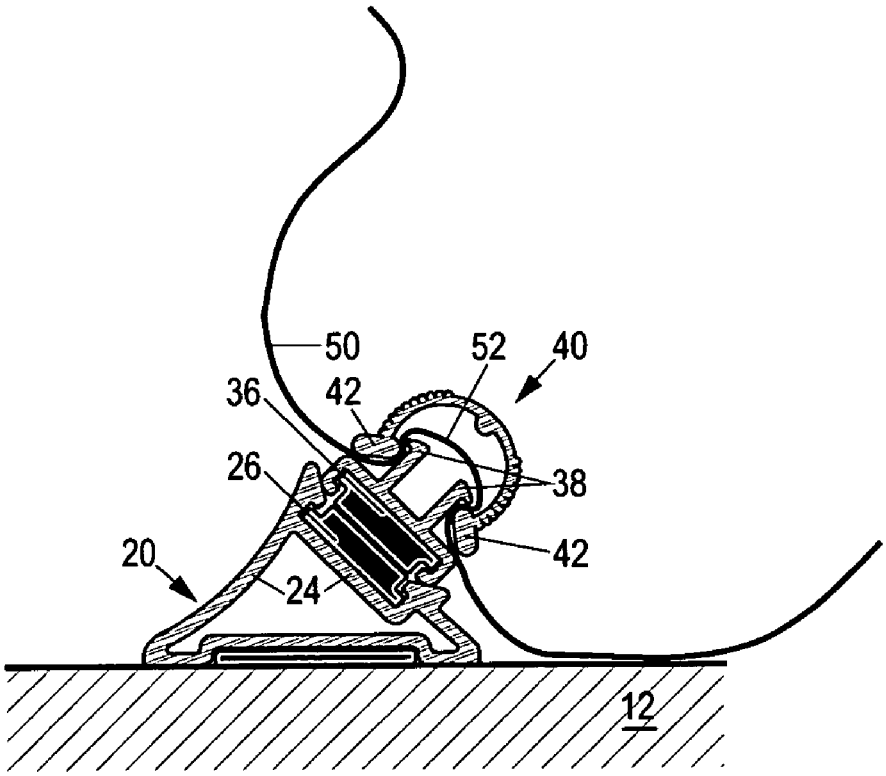
FIG. 5 is a cross-sectional view of the kit according to the present invention in a closed position.
Figure 6:
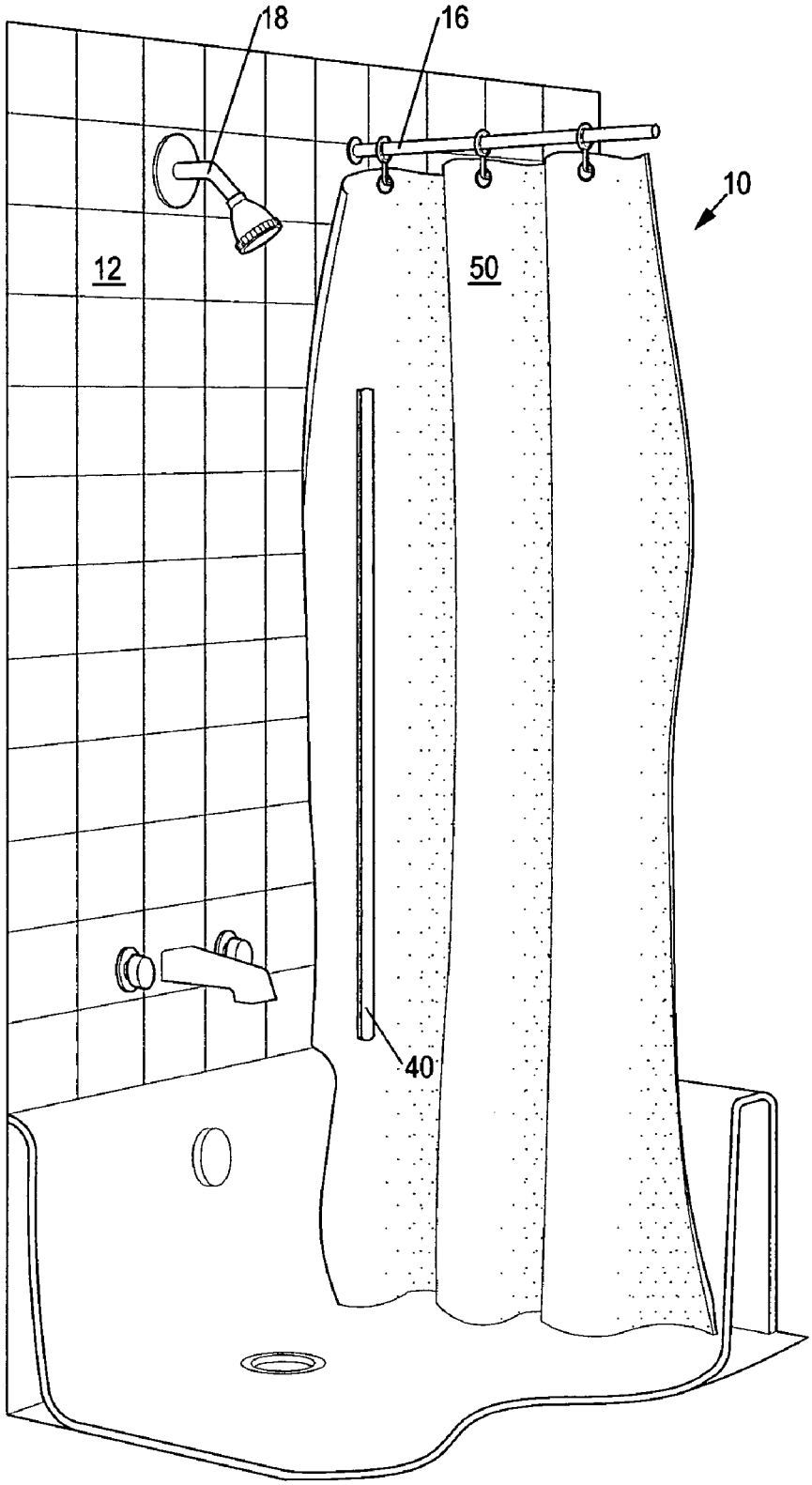
FIG. 6 is a perspective view of the kit according to the present invention in an attached position.

As can be seen in FIGS. 4, 5 and 7 to 9, the wall component 20 also contains at least one front wall 24. In a preferred embodiment of the invention, the wall component 20 preferably consists of only one front wall 24. In this particular case, the wall component 20 represents a substantially flat surface (see FIGS. 7 to 9) whereupon the connecting component 30 can be attached thereon by means of magnets 26, 36 so as to form the watertight barrier. Alternatively, as seen in FIGS. 4 and 5, the wall component may also have two front walls. In this case, the two front walls 24 converge towards one another and are joined together at their extremities thus forming a pyramid like structure. This particular pyramid like structure enables the connecting component 30 to be attached onto one of the two front walls by means of said magnets 26, 36 so as to form the watertight barrier. It is worth mentioning that the at least one front wall 24 containing magnets 26 should preferably be positioned in the interior of the shower enclosure 10 so that the retaining component 40, when attached onto the connecting component 30, can be used as a handle. This particular feature, as shown in FIG. 6, is advantageous in that it would allow a user to easily handle the retaining component 40 and attach or detach the connecting component 30 onto the wall component 20.

From the above, it can be deduced that the at least one front wall 24 of the wall component 20 serves as a point of contact with the connecting component 30. In turn, the connecting component 30 is made up of a front portion 32 and a back portion 34. In making reference to FIGS. 4 and 5, it can be seen that the back portion 34 of the connecting component 30 is preferably detachably connectable to one of the at least one front wall 24 of the wall component 20 by means of magnets 26, 36 attached thereto. To this effect, it should be noted that once the wall component 20 and the connecting component 30 are connected to one another by means of magnets 26,36, they form a watertight barrier thus preventing any splashing water from leaving the shower enclosure 10.

As will be apparent from FIG. 4, the front portion 32 of said connecting component 30 contains a protrusion 38. Preferably, the protrusion 38 is in the form of two spaced apart, elongated symmetrical arms that are each provided with an abutting edge against which part 52 of the shower curtain 50 may be positioned. The particular form of the protrusion 38 is important in that it allows part 52 of the shower curtain 50 of various thicknesses to be pinched in between the protrusion 38 and the retaining component 40 which is then snapped thereon. It is worth mentioning that the form of the protrusion 38 can be altered in several ways. For example, the abutting edge of the two spaced apart elongated arms of the protrusion may be in the form of a triangle, a rectangle, a square and/or circular. Other alterations may include the filling out of the space between the two spaced apart elongated arms, and/or the replacement of the abutting edge with a bulb like structure on which the retaining component may affix itself onto.

Detachably connectable onto the protrusion 38 is the retaining component 40. As also seen in FIGS. 4 and 5, the retaining component 40 is detachably connectable to the protrusion 38 of the connecting component 30 with the part 52 of the shower curtain 50 snapped in between. In a preferred embodiment, the retaining component 40 comprises a pair of arms with end edges 42 that face toward each other and are sized to snap onto the abutting edges of the elongated arms of the protrusion 38 of the connecting component with the part 52 of the shower curtain 50 pinched in between. It is to be understood that the snapping interaction between the retaining component 40 and the protrusion 38 is important in that, by virtue of their design, the retaining component 40, preferably acting as a handle, is securely attached onto the protrusion and that there is a minimal chance that it pops out of place. Such is demonstrated in FIG. 5, where it is seen that the edges 42 of the retaining component snap over the abutting edge of each of the two spaced apart elongated arms of the protrusion 38 against which part 52 of the shower curtain 50 may be positioned.

As it can be further seen in FIG. 2, the wall component 20, connecting component 30 and retaining component 40 have a length equal to or smaller than the length (i.e. height) of the shower curtain. In other words, the lengths of each of the aforementioned components may be cut at a predetermined length so as to substantially fit to the variable lengths (i.e. height) of different shower curtains. For example, it is not uncommon in Europe that shower curtains are longer than those in North America as the shower enclosures may not contain bathtubs but only a drain in the floor. As such, the length (i.e. height) of the shower curtain must be taken into account so as provide a kit 1 with appropriate length of the wall component, connecting component and retaining component.

In making reference to FIG. 4 and FIG. 5, and with particular regard to the magnets 26,36 located on the wall component 20 and the connecting component 30, it is worth mentioning that the magnets 26,36 are of opposite polarities. Indeed, by virtue of the magnets' 26,36 magnetic properties, they ensure the formation of a watertight barrier between the wall component 20 and the connecting component 30. It is worth mentioning that the properties of the magnets 26,36 may be improved so as to include self-aligning means, a stronger force of attraction between the magnets 26,36 positioned on the wall component 20 and the connecting component 30.

Figure 3:
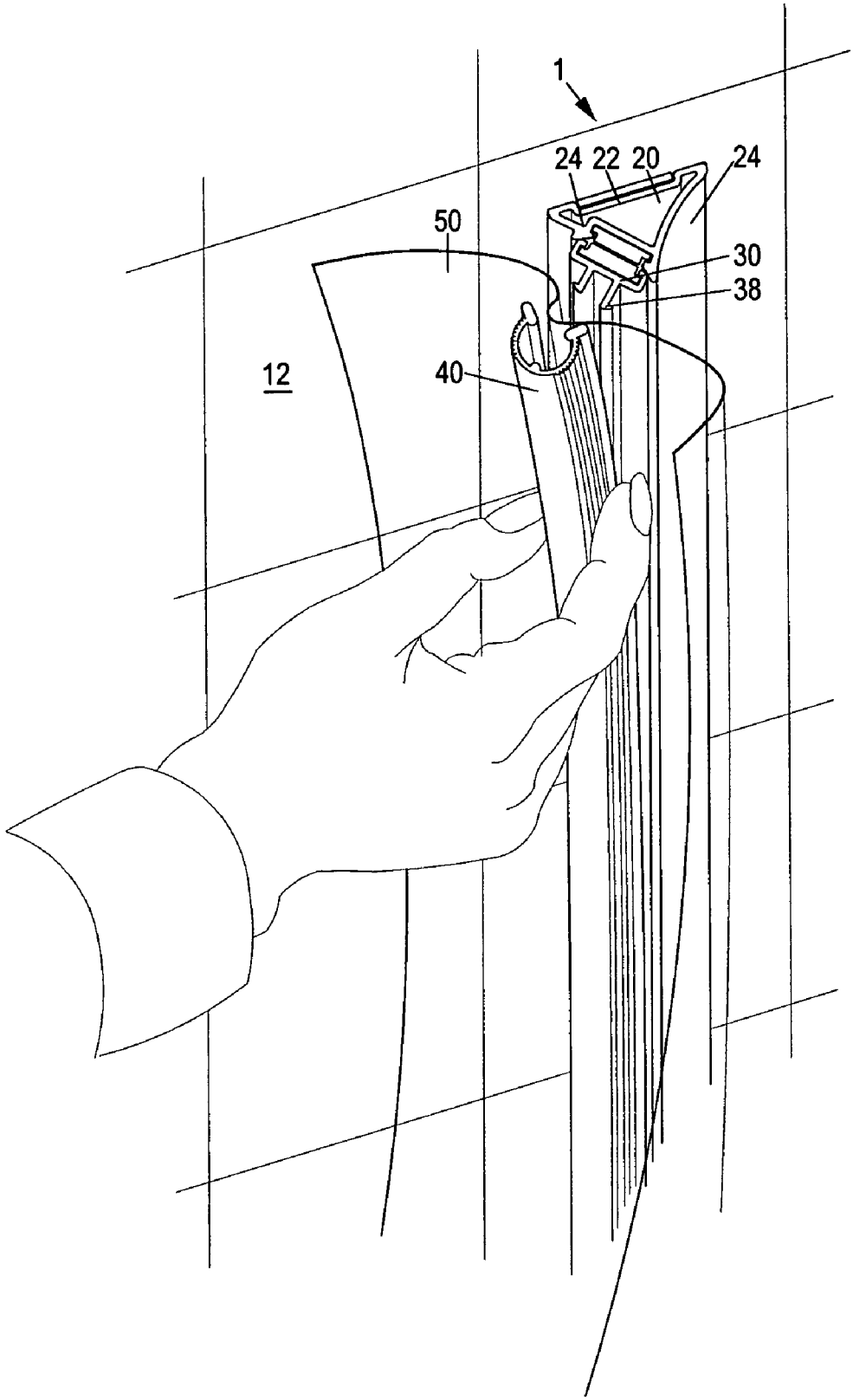
FIG. 3 is a view of perspective view of the kit according to another preferred embodiment of the invention.

As seen in FIGS. 2 and 3, the magnets 26,36 are preferably continuously positioned along the at least one wall of the wall component 20 and the back portion of the connecting component 30. Nevertheless, it is possible to change the configuration of the magnets 26,36. Indeed, instead of using magnets 26,36 along the length of the aforementioned wall component 20 and connecting component 30, use can be made of magnetic sections (i.e. rectangular or disc shaped magnets). In other words, the wall component 20 and connecting component 30 may be outfitted with sections of magnets positioned at predetermined locations for wall component 20 and connecting component 30 to align and connect to one another.

Figure 7:
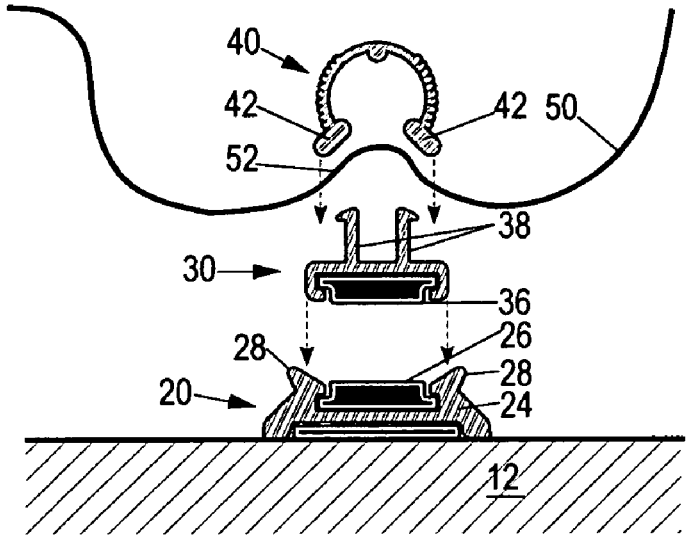
FIGS. 7 to 9 are cross-sectional views of the kit according to the present invention.
Figure 8:
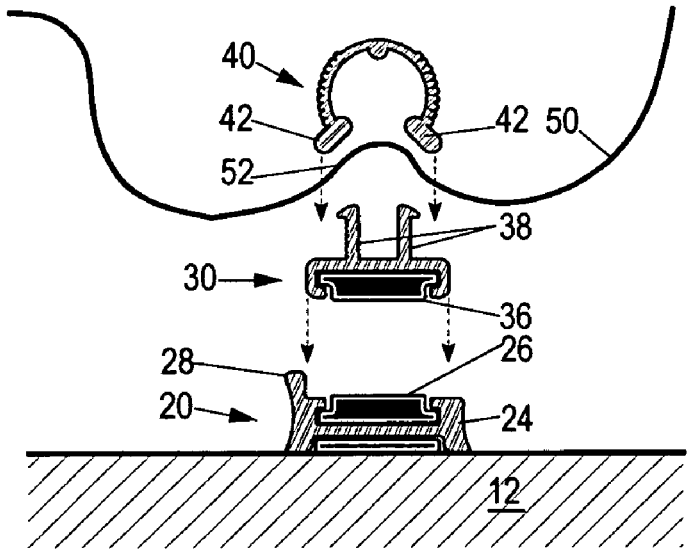
Figure 9:
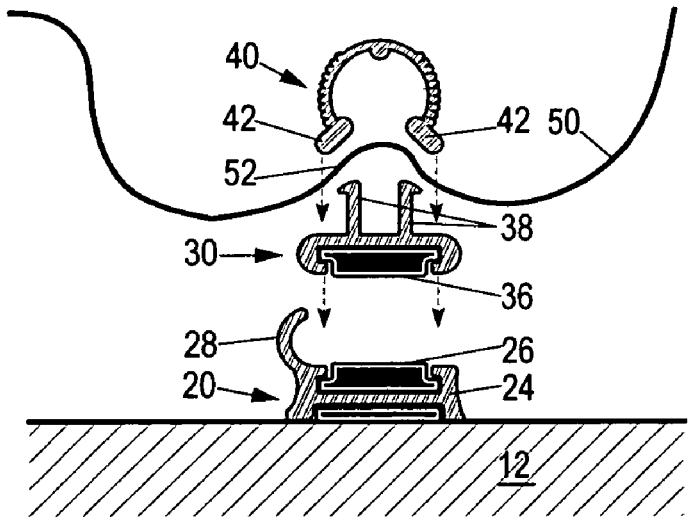

In another preferred embodiment of the invention, and as seen in FIGS. 7 to 9, the at least one front wall 24 of wall component 20 may be outfitted with at least one abutment 28. The addition of an abutment to the at least one front wall 24 of the wall component 20 is preferable in that it allows to guide the connecting component 30 into place and enable it to be attached onto the front wall 24 by means of magnets 26,36 so as to form the watertight barrier.

In yet another preferred embodiment of the invention, the wall component 20, connecting component 30 and retaining component 40 can be made of different or similar materials. In other words, the aforementioned components can either be made of metal or plastic or any other material known to a person skilled in the art. In this connection, it is worth mentioning that different combinations of materials can be used on any of the components 20, 30, 40. For example, the wall component 20 could be made of metal and the connecting component 30 and retaining component 40 could be made of plastic. Alternatively, the wall component 20 and connecting component 30 could be made of metal and the retaining component 40 could be made of plastic. As it can be noticed, different combinations of materials can be envisaged, and the kit 1 according to the present invention does not prejudice the use of any of these materials (i.e. plastic, metal or the like) on any of its components. Nonetheless, it is worth mentioning that if the wall component 20 is made of metal, such as ferrous non corrosive metal (i.e. 400 series stainless steel), magnets 26 would not be required, as the magnets 36 of the connecting component could easily connect onto the metallic surface of the wall component 20. Nevertheless, it is worth reminding the lector that this feature is only a preferred embodiment of the invention.

Once the wall component 20 has been adhered onto wall surface 12 and the retaining component 40 has been snapped onto the protrusion 38 of the connecting component 30 with the part of the shower curtain pinched in between, the kit is ready for operation. In operation, a person taking a shower would first step into the tub and draw the handle, for example the retaining component 40 connected onto the connecting component 30 with part of the shower curtain pinched in between, towards the wall component 20. The person will then line the connecting component 30 with the wall component 20, whereupon the magnets 26,36 of opposite polarity will then attract themselves one to another, thus closing the existing space between the two aforementioned components 20, 30. More specifically, the back portion of connecting component will detachably connect onto one of said at least one front wall of the wall component by means of magnets attached thereto. Once the wall component and connecting component are connected, they form a watertight barrier.

With this kit, water cannot escape between the wall surfaces 12 and the various components 20, 30 and 40 of the kit 1, especially when connected together, in view of the watertight barrier. Accordingly, the floor of the bathroom in which the shower enclosure is used will not get wet due to water escaping from the shower through the space usually existing between the curtain and the wall surface or from poorly designed tubs that allow pools of water to gather and flow on the floor.

It is worth mentioning that the invention described hereinabove may be used for other applications, where it is desirable to temporarily hold curtains and the like. Examples of such may include and are not limited to curtains used in stand-up shower stalls, vestibules, carports, temporary doors (i.e. garage, side doors) and the like, window openings on recreational vehicles and shower enclosures on cruise lines.

Although several embodiments have been described, this was for the purpose of illustrating, but not limiting, the invention. Various modifications, which will come readily to the mind of one skilled in the art, are within the scope of the invention as defined in the appended claims.

What is claimed is:

1. A kit for use in a shower enclosure with a shower curtain, said kit comprising:

a wall component having a back wall and at least one front wall, the back wall being removably attachable to a wall surface of the shower enclosure;

a connecting component having a front portion and a back portion, said connecting component having its back portion detachably connectable to one of said at least one front wall of the wall component by means of magnets attached thereto, said wall component and said connecting component once connected forming a watertight barrier, the front portion of said connecting component having a protrusion in the form of two spaced apart, elongated symmetrical arms that are each provided with an abutting edge against which part of the shower curtain may be positioned; and a retaining component detachably connectable to the protrusion of the connecting component with the part of the shower curtain snapped in between, said retaining component comprising a pair of arms defining an aperture in communication with a hollow portion, the pair of arms having end edges that face toward each other and are sized to snap onto the abutting edges of the elongated symmetrical arms of the protrusion of the connecting component with the part of the shower curtain pinched in between the arms and within the hollow portion, wherein said magnets comprise a first magnet continuously positioned substantially along the entire length of the at least one front wall of the wall component, and a second magnet continuously positioned substantially along the entire length of the back portion of the connecting component.

2. The kit according to claim 1, characterized in that said at least one front wall of said wall component contains at least one abutment designed to guide said connecting component into place and enabling it to be attached onto said front wall by means of said magnets so as to form the watertight barrier.

3. The kit according to claim 1, characterized in that said wall component contains two front walls which converge towards one another and are joined together at their extremities thus forming a pyramid like structure, said pyramid like structure enabling the connecting component to be attached onto one of the two front walls by means of said magnets so as to form the watertight barrier.

4. The kit according to claim 1, characterized in that said wall component, said connecting component and said retaining component are made of metal.

5. The kit according to claim 1, characterized in that said wall component, said connecting component and retaining component are made of plastic.

6. The kit according to claim 1, characterized in that said wall component is made of metal and said connecting component and said retaining component are made of plastic.

7. The kit according to claim 1, characterized in that said wall component and connecting component are made of metal and said retaining component are made of plastic.

* * * * *